US005834147A

United States Patent [19]

Nagae et al.

[11] Patent Number: 5,834,147

[45] Date of Patent: Nov. 10, 1998

[54] PHOTOSENSITIVE MEMBER FOR ELECTROPHOTOGRAPHY

[75] Inventors: Suguru Nagae; Kazuko Wakita; Toshio Kobayashi; Yoshimi Sugimoto; Sei Tsunoda; Kikuo Hayama; Koe Enmanji, all of Amagasaki, Japan

[73] Assignee: Mitsubishi Denki Kabushiki Kaisha, Tokyo, Japan

[21] Appl. No.: 691,305

[22] Filed: Aug. 2, 1996

Related U.S. Application Data

[63] Continuation of Ser. No. 332,741, Nov. 1, 1994, abandoned.

[30] Foreign Application Priority Data

| | | | |
|---|---|---|---|
| Nov. 5, 1993 | [JP] | Japan | 5-276877 |
| Nov. 5, 1993 | [JP] | Japan | 5-276878 |
| Nov. 5, 1993 | [JP] | Japan | 5-276879 |
| May 6, 1994 | [JP] | Japan | 6-094318 |

[51] Int. Cl.[6] ..... G03G 5/05; G03G 5/147

[52] U.S. Cl. ..... 430/67; 430/56; 430/66; 430/78; 430/96

[58] Field of Search ..... 430/66, 67, 96, 430/78, 56, 64, 65

[56] References Cited

U.S. PATENT DOCUMENTS

| | | | |
|---|---|---|---|
| 3,357,989 | 12/1967 | Byrne et al. | 260/314.5 |
| 4,335,195 | 6/1982 | Nishigaki et al. | 430/94 |
| 4,444,862 | 4/1984 | Yagi et al. | 430/67 |
| 4,565,758 | 1/1986 | Tachiki et al. | 430/66 |
| 4,963,452 | 10/1990 | Kinoshita | 430/78 |
| 4,963,453 | 10/1990 | Kinoshita | 430/96 |
| 5,096,793 | 3/1992 | Osawa et al. | 430/58 |
| 5,124,219 | 6/1992 | Shintani et al. | 430/66 |
| 5,135,834 | 8/1992 | Hanatani et al. | 430/66 |
| 5,320,923 | 6/1994 | Nguyen | 430/78 |
| 5,443,935 | 8/1995 | Kojima et al. | 430/78 |

FOREIGN PATENT DOCUMENTS

| | | | |
|---|---|---|---|
| 59-19946 | 2/1984 | Japan | 430/96 |
| 60-003640 | 1/1985 | Japan | 430/66 |
| 64-3670 | 1/1989 | Japan | 430/66 |
| 64-52162 | 2/1989 | Japan | 430/96 |
| 5-150531 | 6/1993 | Japan | 430/66 |

OTHER PUBLICATIONS

Patent & Trademark English Language Translation of Japanese Patent Application 59–19946 (Pub Feb. 1984).

Patent & Trademark Office English–Language Translation of JP 60–003640 (Pub Jan. 1985).

*Primary Examiner*—Janis L. Dote

*Attorney, Agent, or Firm*—Leydig, Voit & Mayer

[57] ABSTRACT

A photosensitive member for electrophotography having excellent electrophotographic characteristics such as chargeability, photosensitivity and dark attenuation, excellent corona resistance and excellent durability, which comprises an electrically conductive support and a photosensitive layer containing a resin binder and particles of a photoconductive phthalocyanine compound dispersed in said binder, said photosensitive layer containing at least one member selected from the group consisting of an electron acceptive material, a coupling agent, an antioxidant and a hydroxyl group-containing polymer.

42 Claims, 1 Drawing Sheet

PHOTOSENSITIVE MEMBER FOR ELECTROPHOTOGRAPHY

This disclosure is a continuation of patent application Ser. No. 08/332,741, filed Nov. 1, 1994, now abandoned.

BACKGROUND OF THE INVENTION

The present invention relates to a photosensitive member for electrophotography for use in electrophotographic copying machines, printers and the like.

Electophotographic recording applied to copying machines, printers and the like is effected by a method for forming an image including the steps of charging a surface of photosensitive layer of a photosensitive member, effecting an exposure to form an electrostatic latent image, visualizing (developing) the electrostatic latent image with a toner, and transferring and fixing the visualized image onto a receptor such as a paper sheet. The photosensitive member is further subjected to surface cleaning such as removal of the toner adhering to the photosensitive member and removal of the charge for repeated use of the member.

Photosensitive members for use in such electrophotographic recording are required to have electrophotographic characteristics such as good chargeability, good photosensitivity and minimal dark attenuation and, in addition thereto, minimal change in the foregoing electrophotographic characteristics with the lapse of time in repeated use, excellent physical properties such as printing durability, abrasion resistance and moisture resistance, and excellent chemical resistances such as against ozone and $NO_x$ produced when charged.

There have been used inorganic materials such as selenium, cadmium sulfide and zinc oxide as the photoreceptors of the photosensitive members for electrophotography. In recent years, however, organic photoconductive materials such as azo, perylene, phthalocyanine and quinacridone compounds have increasingly been used to cope with toxicity problem of the inorganic materials, and to cope with enhanced luminance of an exposure light source with increasing operating speeds of copying machines, printers or the like, namely the use of a longer wavelength for the exposure owing to the use of a semiconductor laser or LED. Nevertheless, organic materials are inferior to inorganic materials in durability and stability against environmental changes.

The photosensitive members are classified into positively chargeable types and negatively chargeable types. Among the organic photosensitive members, intensive attention is now being paid to positively chargeable types that are capable of minimizing the amount of ozone produced upon corona charging from the viewpoint of user safety. The superiority of photoconductive phthalocyanine compounds positively chargeable type organic photosensitive members compared to other materials is well known from, for example, U.S. Pat. No. 3,816,118 and Japanese Patent Publication Kokoku No. 49-4338. The phthalocyanine compounds not only have large absorbance and excellent heat resistance, chemical resistance and light fastness, they also exhibit high photoconductivity responsive to the application of light, namely, excellent efficiency of electron-hole pair generation.

However, positively chargeable photosensitive members using the phthalocyanine compounds are known to be less resistant against ozone and $NO_x$ produced from a charging device, and hence their electric characteristics are prone to degrade with repeated use.

The positively chargeable photosensitive members generally include an undercoat layer provided on a substrate or support such as an aluminum drum and a photosensitive layer containing photoconductive phthalocyanine compound particles dispersed in a binder resin overlying the undercoat layer. Polyester-melamine resins are preferred as the binder resin for use in such photosensitive members, as disclosed in Japanese Patent Publication Kokai No. 1-169454. Such resins impart satisfactory electric characteristics, moisture resistance and durability to the photosensitive members.

However, a photosensitive liquid in which photoconductive phthalocyanine compound particles are dispersed in a solvent together with the binder such as a polyester-melamine resin is extremely poor in dispersion stability since the photoconductive phthalocyanine compound particles agglomerate. Hence, it is required to coat the photosensitive liquid onto the undercoat layer immediately after dispersing the compound particles so as to manufacture a photosensitive member having uniform characteristics. Where the coating is made using a photosensitive liquid containing agglomerated particles, the resulting photosensitive member has portions (very small regions) having higher concentration of the photoconductive phthalocyanine compound particles than other portions. Such higher concentration portions have a reduced charge retentivity and hence result in formation of black points or white voids in a print. On the other hand, in case of other binder resins such as butyral resin or cellulose which do not cause the agglomeration of photoconductive phthalocyanine compound particles, the resulting photosensitive member has unsatisfactory moisture resistance and durability.

An easily conceivable approach to solve the problem of the nonuniformity in the electrophotographic characteristics of a photosensitive member attributable to the unstability of the photosensitive liquid containing phthalocyanine compound particles is to stabilize the photosensitive liquid using a dispersion stabilizer which has been used in the field of coatings. It was attempted to add zinc stearate generally known as a dispersion stabilizer to a photosensitive liquid, a photosensitive member produced using this photosensitive liquid was found to exhibit degraded electrophotographic characteristics such as increased dark attenuation, though the dispersion stability of photoconductive phthlocyanine compound particles in the photosensitive liquid was improved.

Generally known constitutions of organic photosensitive members of the positively chargeable type include one comprising only a photoconductive (photosensitive) layer on an electrically conductive substrate or support coated with an undercoat layer, one further comprising a protective layer on or over the photoconductive layer, and one comprising a charge transport layer, a photoconductive layer and a protective layer which are successively built up on the substrate or support.

The surface of a photosensitive member is subject to mechanical damage because of contact thereof with toner or a recording paper sheet. The protective layer is provided in order to improve the characteristics of the photosensitive member such as abrasion resistance, printing durability and moisture resistance.

As the protective layers, there are proposed, for instance, those comprising a silicone resin or the like as disclosed in Japanese Patent Publication Kokoku No. 57-39416, and those comprising epoxy resin, acrylic resin, polyester resin, urethane resin or the like as disclosed in Japanese Patent Publication Kokoku No. 57-27453.

Such protective layers, however, are inferior in abrasion resistance while suffering problems of causing the photosensitivity of the photosensitive member to deteriorate and bringing about a possible increase in residual charge on the photosensitive member due to repeated use. As a countermeasure therefor, it is conceivable to make the protective layer significantly thin. However this countermeasure raises another problem that such a protective layer is easily abraded by repeated use and, hence, only a photosensitive member of extremely short life would result.

The reason why the photosensitivity of a photosensitive member is decreased by providing with the conventional protective layer is that in the photosensitive member which has a layer built-up structure and which is adapted to be repeatedly subjected to charging step, exposure step, developing step, transfer step and cleaning step, a charging voltage applied to the photosensitive member at the first charging step is retained by each layer by its share regarded as a capacitor in which the capacitance and resistance of each layer are disposed in series and, therefore, even if a partial charge of the photoconductive layer is removed in the exposure step, a partial charge on the protective layer is likely to remain and hence is accumulated into a residual potential.

For this reason the protective layer must be made significantly thin in order to prevent the photosensitivity of the photosenstive member from decreasing. However, such a thin protective layer has the problem that the life of the photosensitive member is short as described above.

Further, with the progress of color electrophotography in recent years, there has been utilized a system using an intermediate transfer medium such as a transfer roller or transfer belt in superimposing toners of different colors on a photosensitive member. With the conventional protective film, it is impossible to protect against the charge (negative charge, for example) applied to such a transfer medium, thus causing a problem that the electric characteristics of the photosensitive member are easily degraded by repeated use. Accordingly, a photosensitive member having the aforementioned conventional protective layer has the disadvantage of hardly providing stable image quality.

On the other hand, there has been a strong desire to improve the photosensitivity of a photosensitive member since the this is one of the important factors determining the recording speed, or the performance of a recording apparatus.

It is, therefore, an object of the present invention to provide a positively chargeable type photosensitive member for electrophotography which exhibits excellent electrophotographic characteristics such as good changeability, good photosensitivity and a low level of dark attenuation, which is less likely to be changed in such electrophotographic characteristics with time when repeatedly used, and which is excellent in physical properties such as printing durability, abrasion resistance and moisture resistance and in chemical durability against ozone, $NO_x$ and the like which are generated when the photosensitive member is charged.

Another object of the present invention is to provide a positively chargeable type photosensitive member for electrophotography which is improved in ozone resistance without degrading the electrophotographic characteristics thereof such as chargeability, photosensitivity (responsiveness to light) and dark attenuation.

Yet another object of the present invention is to provide a positively chargeable type photosensitive member for electrophotography having an improved photosensitivity with characteristics indispensable for practical use such as performance stability against environment and chargeability being kept satisfactory.

Still another object of the present invention is to provide a positively chargeable type photosensitive member for electrophotography wherein particles of a phthalocyanine compound are uniformly dispersed in the photosensitive layer and, hence, the overall photosensitive member exhibits uniform characteristics without degrading the electrophotographic characteristics such as chargeability, photosensitivity (responsiveness to light) and dark attenuation.

Further still another object of the present invention is to provide a photosensitive member for electrophotography which is improved in abrasion resistance without degrading electrophotographic characteristics such as chargeability, photosensitivity, dark attenuation and digitalization adaptability.

Further object of the present invention is to provide a photosensitive member for electrophotography having a protective layer which can be made thick and can block negative charge applied to an intermediate transfer medium of contact type.

These and other objects of the present invention will become apparent from the description hereinafter.

SUMMARY OF THE INVENTION

In accordance with the present invention, there is provided a photosensitive member comprising an electrically conductive support and a photosensitive layer containing a resin binder and particles of a photoconductive phthalocyanine compound dispersed in said binder, said photosensitive layer containing at least one member selected from the group consisting of an electron acceptive material, a coupling agent, an antioxidant and a hydroxyl group-containing polymer.

DETAILED DESCRIPTION

Figure 1:
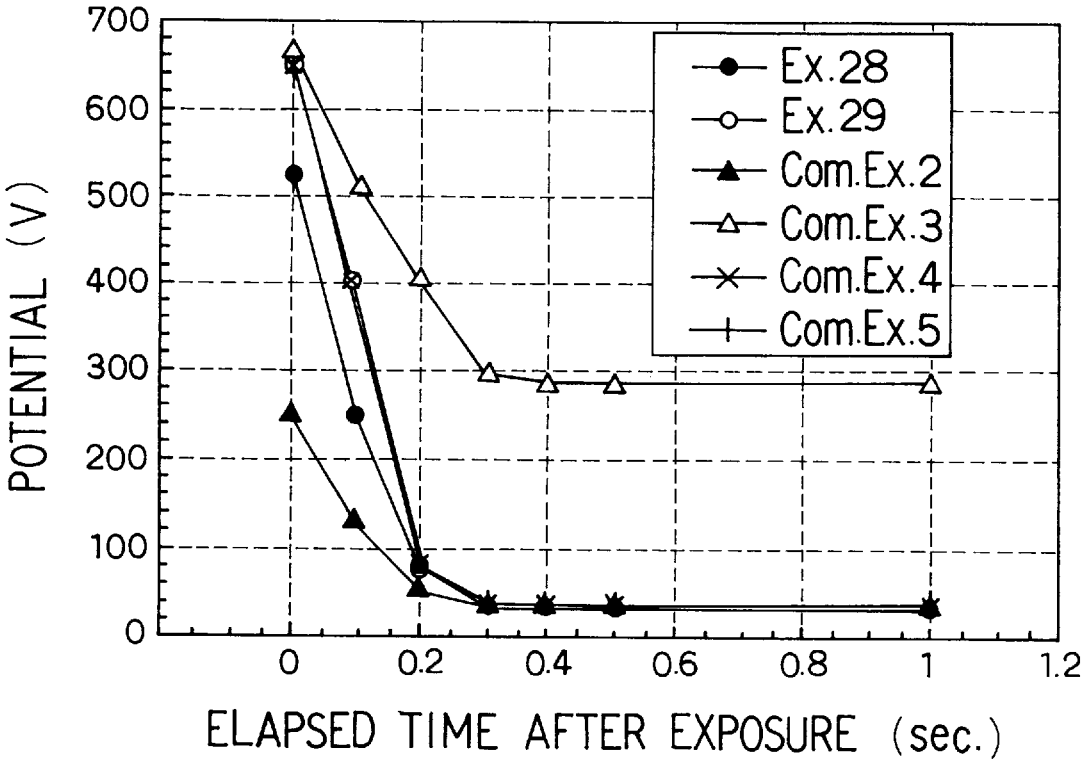
FIG. 1 is a graph showing responsiveness characteristics of photosensitive members.

In the present invention, the electrically conductive substrate or support of the photosensitive member is formed of an electric conductor or an insulator treated for electric conduction. Examples of the electrically conductive substrate are, for instance, those made of metals such as Al, Ni, Fe, Cu, Au and the like or alloys thereof, those comprising an insulator base such as polyester, polycarbonate, polyimide, glass or the like, the insulator base being covered with a thin film of a metal such as Al, Ag or Au or of an electrically conductive material such as $In_2O_2$ or $SnO_2$, and paper sheets treated for electric conduction. Among these, a substrate of Al is preferred in view of its low cost.

The electrically conductive substrate can be in any form without particular limitations, for example, in the form of drum, plate or belt depending on the need.

Although a photosensitive layer (photoconductive layer) may be directly disposed on the electrically conductive substrate, it is a common practice to provide an undercoat layer on the electrically conductive layer and then form the photosensitive layer on the undercoat layer in order to improve the adhesion of the photosensitive layer to the substrate and to impart the photosensitive member with a charge blocking function.

Usable as the undercoat layer are known materials, including organic materials such as polyvinyl alcohol, casein, gelatin, polyvinylmethyl ether, nitrocellulose, polyvinyl butyral, polyamide, methyl cellulose and polyurethane; and inorganic materials such as aluminum oxide or titanium oxide which may be used either alone or with tin oxide, antimony oxide or the like; and these organic materials dispersed in resins such as those mentioned above. The thickness of the undercoat layer is usually within the range of 0.1 to 10 μm. Preferably, the thickness of the undercoat layer is from 0.1 to 4 μm, especially from 0.1 to 2 μm, more especially from 0.5 to 1 μm.

The photosensitive layer is formed in a usual manner by mixing a photoconductive material, a resin binder and a solvent, milling them to prepare a dispersion (photosensitive liquid) using a grinding machine such as paint shaker, ball mill, pebble mill, disper, planetary-micro-pulveriser or the like, coating the dispersion onto a substrate by surface dipping method or spraying method, and drying and, as required, curing the binder resin. The content of the photoconductive material in the photosensitive layer is usually from 10 to 40 by weight %.

Any of the known binder resins conventionally used in the photoconductive layer can be used in the present invention. Preferred are those which exhibit good charge retentivity, have less ionically or radically active groups from the viewpoint of ozone resistance, and serve as a good dispersing medium for the photoconductive compound. Where a phthalocyanine compound is used as the photoconductive compound, preferred binders include acrylic resins, polyester resins, urethane resins, butyral resins, silicone resins and epoxy resins; thermosetting resins wherein thermoplastic resins as listed above are used in combination with amino resins such as melamine resin, or with isocyanate resins or the like; photo-curable resins; and other resins such as polycarbonate resins and polystyrene resins. In the present invention, there is particularly suitably used a thermosetting resin composed of an amino resin, preferably a butanol-modified melamine resin, and an alkyd resin. The mixing ratio of amino resin/alkyd resin is from 10/90 to 40/60 by weight, preferably 20/80 to 40/60 by weight.

Any known organic photoconductive compounds are usable as the photoconductive material (charge generating material) in the present invention. Among these photoconductive materials are suitably selected those having such a photosensitivity as to allow recording by incident light of a desired wavelength. For example, photoconductive materials having an excellent photosensitivity against semiconductor laser light (780 nm) include phthalocyanine compounds such as copper phthalocyanine, metal-free phthalocyanine and titanyloxophthalocyanine. Other compounds having an excellent photosensitivity are perylene compounds, azo compounds and the like. In the present invention the photoconductive phthalocyanine compounds are preferably used.

Such photoconductive phthalocyanine compounds are, for example, those disclosed in known documents such as Japanese Patent Publication Kokoku No. 49-4338 and Japanese Patent Publication Kokai No. 1-169454. Among the photoconductive phthalocyanine compounds are preferably used α-, β-, ε- and x-form crystals of metal-free phthalocyanine. The x-form crystal of metal-free phthalocyanine is particularly preferable in view of its photosensitivity against semiconductor laser light. Metal phthalocyanine compounds include, for example, α-copper phthalocyanine and titanyl phthalocyanine. In a metal phthalocyanine compound, a metal is ideally coordinated with phthalocyanine to maintain electrical neutrality. However, defective portions are likely to be generated in an actual metal phthalocyanine compound and will be easily oxidized by ozone. In a metal-free phthalocyanine compound, in contrast, phthalocyanine is coordinated only with a small hydrogen atom and, hence, a coordination defect is hard to generate. When attention is paid to high sensitivity, titanyl phthalocyanine is also a preferable compound.

As a matter of course, the average particle size of the photoconductive compound is preferably smaller for better dispersion and hence is not more than 0.5 μm. In the case of the phthalocyanine compounds, the average particle size is usually from 0.05 to 1 μm, preferably 0.1 to 0.2 μm. It is difficult to pulverize the compounds to an average particle size of less than 0.1 μm, and even if such pulverization is realized, the resulting particles frequently lose the crystal form. When the average particle size is more than 0.2 μm, electrophotographic characteristics tend to deteriorate.

The content of the photoconductive phthalocyanine compound in the photosensitive layer is from 15 to 40% by weight, preferably 20 to 35% by weight. The content of 15 to 40% is essential for the photosensitive member to function as a positively chargeable type photosensitive member. If the content is less than the above range, the obtained photosensitive member has only an extremely decreased photosensitivity, whereas if it exceeds the above range, the bulk resistance of the obtained photosensitive member is decreased, thus resulting in decreased charge retentivity. From the viewpoint of a balance between photosensitivity and charge retentivity, it is more preferable that the content of the photoconductive phthalocyanine compound in the photosensitive layer is from 25 to 30% by weight, especially from 20 to 30% by weight.

The thickness of the photosensitive layer is preferably within the range of 10 to 30 μm. If the thickness is less than that range, the charge retentivity is decreased, and pinholes are easy to be formed, resulting in a significant deterioration in physical characteristics such as printing durability. On the other hand, if the thickness of the photosensitive layer is more than that range, the optical response speed of the photosensitive layer becomes insufficient while at the same time the expensive photoconductive material must be used in an increased amount uneconomically. In view of both charge retentivity and optical response speed, the thickness more preferably ranges from 15 to 25 μm.

For the purposes of, for example, enhancing the photosensitivity, the photosensitive layer may be incorporated with a charge transport material. The charge transport material is appropriately selected from those conventionally used such as heterocyclic compounds, hydrazone compounds and arylamine compounds.

On the photosensitive layer may be further formed a protective layer to enhance the characteristics of the photosensitive member such as the printing durability, abrasion resistance and moisture resistance. Further, an intermediate layer may be provided between the photosensitive layer and the protective layer for the purpose of enhancing the adhesiveness therebetween. Any of conventionally used resins can be used in the present invention for each of the protective layer and intermediate layer. These layers can be formed by dissolving a resin in an appropriate solvent, coating the resulting solution onto the photosensitive layer by dipping, spraying or the like, and drying the coating, followed by optional curing.

The thickness of the protective layer is usually from 0.1 to 5 μm, preferably 0.1 to 2 μm.

The coating liquid for the formation of the photosensitive layer is prepared by mixing particles of a photoconductive compound, a resin binder and a solvent according to a common procedure. Usable as the solvent are organic solvents capable of dissolving the binder resin. To obtain a photosenstive layer having uniform characteristics, the coating liquid is required to contain the photoconductive compound particles uniformly dispersed in the solution of the binder, thus it is desired to have an excellent dispersion stability.

A polyester-melamine resin imparts the photosensitive layer with excellent electric characteristics, moisture resistance and durability and hence is advantageously used as the binder for the photosensitive layer as mentioned above. However, where this binder resin is used with the photoconductive phthalocyanine compound, the particles of the compound agglomerate undesirably. Further, the phthalocyanine compound is apt to cause crystal growth in the coating liquid with the lapse of time. Accordingly, the coating liquid containing the phthalocyanine compound is poor in dispersion stability. For this reason, such a coating liquid is required to be applied onto a substrate immediately after the preparation.

It has now been found that the agglomeration and crystal growth of phthalocyanine compound particles can be prevented by treating the particles with a hydroxyl group-containing polymer so that any interaction works between the surface of each particle and the hydroxyl group-containing polymer or the surface of each particle is partially or entirely covered with the hydroxyl group-containing polymer. Accordingly, a photoconductive material obtained by treating the surface of photoconductive phthalocyanine compound particles with the hydroxyl group-containing polymer has an excellent dispersion stability.

Preferable example of the hydroxyl group-containing polymer used in the present invention are, for example, polyvinyl butyral, polyvinyl acetal, polyvinyl formal and the like, but are not limited thereto. These polymers may be used alone or in admixture thereof.

The surface treatment of the phthalocyanine compound particles with the hydroxyl group-containing polymer is achieved by dissolving 0.1 to 50% by weight of the hydroxyl group-containing polymer based on the phthalocyanine compound in a solvent, adding the phthalocyanine compound to the resulting solution, and mixing the mixture by a grinding machine or dispersing kneader such as a paint shaker or a satellite ball mill. The solvent is generally used in an amount slightly larger in volume than that of the phthalocyanine compound to be treated.

The surface treatment itself is completed in a short time, but the mixing or milling is usually conducted at room temperature for about 10 minutes to about 3 hours, especially about 10 to about 60 minutes. The particles thus surface-treated may be recovered as solid (dried) particles having an improved dispersion stability by removing the solvent and drying the particles, or by isolating the particles from the liquid mixture and drying the same. Nevertheless, it is convenient that a binder resin is further added to the liquid mixture containing the particles and the resulting mixture is further mixed or milled to prepare the coating liquid for the formation of the photosenstive layer.

Examples of the solvents used in dissolving the hydroxyl group-containing polymer for the treatment of the phthalocyanine compound and then preparing the photosensitive coating liquid are, for instance, an aromatic solvent such as toluene or xylene; a ketone solvent such as methyl ethyle ketone (MEK), dibutyl ketone, acetone or cyclohexane; an ester solvent such as ethyle acetate or isobutyl acetate; an ether solvent such as tetrahydrofuran (THF); and an alcohol solvent such as methanol, ethanol or butanol. Among these, the aromatic solvents and ketone solvents are preferable from the viewpoint of solvency and coating property, and toluene and MEK are especially preferable from the viewpoint of coating property.

The hydroxyl group-containing polymer is used in an amount of 0.1 to 50% by weight, preferably 0.5 to 10% by weight, based on the phthalocyamine compound. If the amount of the hydroxyl group-containing polymer is less than 0.1% by weight, the dispersion stability of the particles is not sufficiently improved, and if the amount is more than 50% by weight, the moisture resistance and durability of the resulting photosensitive layer tend to degrade. When the hydroxyl group-containing polymer is used within the above range, the agglomeration and crystal growth of the phthalocyanine compound particles can be suppressed to enhance the dispersion stability of the phthalocyanine compound particles. Further, it is possible to obtain a photosensitive layer having uniform electrophotographic characteristics without degrading the electrophotographic characteristics such as chargeability, photosensitivity (optical responsiveness) and dark attenuation.

Since the phthalocyanine compound surface-treated with the hydroxyl group-containing polymer has an excellent dispersion stability, its use is advantageous when used with dispersion-instable binder resins such as polyester, polystyrene, polymethylmethacrylate, polyamide, styrene-acryl copolymer and styrene-acrylonitrile copolymer, especially with polyester-melamine resins.

Where the surface-treated phthalocyanine compound is used with a polyester-melamine resin as a binder, there can be obtained a photosensitive layer containing the photoconductive phthalocyanine compound particles uniformly dispersed in the cured binder resin, for example, by coating a substrate with the photosensitive coating liquid in a dipping or other appropriate manner, drying the coating at room temperature, for example, at 22° C. for 8 hours, and then heating at a temperature of 120° to 220° C., preferably 140° to 150° C., for 0.5 to 5 hours, preferably 3 to 4 hours.

In electrophotography, the photosensitivity of photosensitive members is one of important factors determining the recording speed, namely performance of recording devices. In order to improve the photosensitivity of photosensitive members, a study has hitherto been made about photoconductive compounds having a higher photosensitivity. On the other hand, in improving the photosensitivity it is also effective to add a sensitizer to a photoconductive compound. However, sensitizers hitherto proposed are not always satisfactory, since other characteristics such as stability to environment, which is indispensable for practical use of photosensitive members, and chargeability are decreased even if the photosensitivity can be improved.

The photosensitivity can be further improved without impairing basic electrophotographic characteristics such as stability to environment and charging stability by adding an electron acceptive material to a photosensitive layer containing a photoconductive phthalocyanine compound. Thus, in accordance with one of the preferred embodiments, the present invention provides a positively chargeable photosensitive member for electrophotography comprising a photosensitive layer comprising a photoconductive phthalocyanine compound, a resin binder and an electron acceptive material.

Electron acceptive compounds which form a charge-transfer complex with phthalocyanine or undergo any interaction with phthalocyanine to improve the photosensitivity, can be used in the present invention. Representative examples of the electron acceptive compound used in the present invention are, for instance, tetracyanoethylene, tetracyanoquinodimethane and trinitrofluorenone. Tetracyanoethylene is particularly preferred.

The electron acceptive compound is used in an amount of at most 4% by weight, preferably 0.1 to 2% by weight, based on the photosensitive layer.

Phthalocyanine compounds are preferably used in the present invention as the photoconductive material, since they have not only a high absorbance and excellent heat, chemical and light resistances, but also an excellent photoconductivity. However, these compounds are inferior in ozone resistance and, therefore, the life of photosensitive members prepared using them is extremely short when used repeatedly and when used under temperature and humidity conditions under which the rate of ozone generation is high.

As a countermeasure for solving this problem, it is easily conceivable to provide an over coating layer on a photosensitive layer so that the photosensitive member is not exposed directly to ozone atmosphere. It is known to dispose an over coating layer on the photosensitive layer for the purpose of, as disclosed in U.S. Pat. No. 3,816,118, physically protecting the photosensitive layer, namely improving the properties such as printing durability, abrasion resistance and moisture resistance. Such a protective layer is effective in this respect, but it is also confirmed that new problems are encountered by the disposition of the over coating layer. That is to say, the photosensitivity of the photosensitive member is lowered by disposing the over coating layer, and the photosensitivity varies with the lapse of time if the over coating layer mechanically wears away during the use. The present inventors further found that with respect to the ozone resistance in issue, ozone is not necessarily blocked by the over coating layer. That is to say, the present inventors experimentally confirmed that ozone permeates through the over coating layer into the photosensitive layer, thus exerting a bad influence on the characteristics of the photosensitive member, when exposed to an ozone atmosphere for a long time.

The present inventors have investigated in detail the mechanism of deterioration of photosensitive members owing to ozone, and have found that chemically defective portions in the photosensitive members are selectively attacked by ozone. The chemically defective portions in the photosensitive members are, for instance, a structural defect of a phthalocyanine compound used as a photoconductive material, e.g. a defect such that one atom such as hydrogen atom is missed, and a structural defect of a binder resin. These defects are usually present as long-life ionically or radically active species and are stable under normal conditions, but have a tendency to easily decompose when exposed to ozone or other materials having a high reactivity. The ozone problem can be solved if a photosensitive member free of defects can be prepared, but it is not practical from an economic point of view to prepare the photosensitive member using a highly pure defect-free material.

It has now been found that deterioration of photosensitive layers owing to chemical change can be prevented by surface treatment of particles of a photoconductive phthalocyanine compound with a coupling agent, and the coupling agent serves to protect an active site which is decomposable by ozone or the like, thus stabilizing the image quality even during continuous use of the photosensitive member, and further that substantially the same results, namely prevention of the deterioration of the photosensitive layer owing to chemical change, can be achieved also by treating the surface of the photosensitive layer with the coupling agent, or by treating the surface of the photosensitive layer to make it hydrophobic, and these treating agents serve to protect the ozone-decomposable active site, thereby stabilizing the image quality in the continuous use. It has also been found that when an antioxidant or an ozone-decomposing compound is added to the photosensitive layer, they efficiently absorb active species such as ozone and NOx, whereby the photosensitive layer can be effectively prevented from deteriorating.

Any of known coupling agents as generally used for improving the adhesion between inorganic materials and organic materials can be used in the present invention, e.g. silane coupling agents. titanate coupling agents and aluminate coupling agents. The coupling agents may be used alone or in admixture thereof.

Representative examples of the coupling agent are, for instance, a silane coupling agent of the formula: RSiXn wherein R is an organic functional group having vinyl group, glycidoxy group, methacryloyl group, amino group or mercapto group, X is a hydrolyzable group such as chlorine or an alkoxy group, and n is 2 or 3, e.g. γ-chloropropyltrimethoxysilane, vinyltrichlorosilane, vinyltrimethoxysilane, vinyltriethoxysilane, vinyltris(β-methoxyethoxy)silane, γ-methacryloyloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, γ-aminopropyltriethoxysilane, N-β-(aminoethyl)-γ-aminopropyltrimethoxysilane, γ-ureidopropyltriethoxysilane, N-β-(aminoethyl)-β-aminopropylmethyldimethoxysilane or N-phenyl-γ-aminopropyltrimethoxysilane; and a titanate coupling agent such as isopropyltriisostearoyl titanate, isopropyltridecylbenzenesulfonyl titanate, isopropyltris(dioctylpyrophosphate) titanate, tetraisopropylbis(dioctylphosphite) titanate, tatraoctylbis(ditridecylphosphite) titanate, tetra(2, 2-diallyloxymethyl-1-butyl)bis(di-tridecyl)phosphite titanate, bis(dioctylpyrophosphate)oxyacetate titanate or tris(dioctylpyrophosphate)ethylene titanate.

The treatment of the surface of particles of a photoconductive phthalocyanine compound with a coupling agent can be easily achieved by adding the particles of phthalocyanine compound to a solution of the coupling agent in an organic solvent, and stirring the solution. It is advantageous to prepare a dispersion by adding the phthalocyanine compound and the coupling agent to a solvent, and mixing or milling the resulting mixture using a grinding machine such as a paint shaker, and to directly use the thus obtained dispersion in the preparation of a photosensitive liquid for forming the photosensitive layer. In that case, the surface treatment is usually carried out at room temperature for about 10 to about 60 minutes, to the resulting dispersion is then added a resin binder, optionally with an additional amount of a solvent, and the dispersion is further kneaded by a grinding machine or a kneader at room temperature for about 30 minutes to about 4 hours to give the photosensitive coating liquid.

Solvents as used in the preparation of the coating liquid for the photosensitive layer can be suitably used as the solvents for the treatment with coupling agent. Examples of such solvents are, for instance, an aromatic hydrocarbon such as toluene or xylene, a ketone solvent such a methyl ethyl ketone or acetone, an ester solvent such as ethyl acetate or butyl acetate, an ether solvent such as tetrahydrofuran, and an alcohol such as methanol or ethanol.

The coupling agent is used in an amount of 0.01 to 2.0% by weight based on the photosensitive layer (dry basis), namely based on the total weight of the phthalocyanine compound, the binder and the coupling agent. When the amount is less than this range, sufficient corona resistance is not obtained, and when the amount is more than this range, the responsiveness to light is lowered.

Photosensitive layers having an improved ozone resistance (corona resistance) are obtained, as stated above, by preparing a photosensitive coating liquid containing a photoconductive phthalocyanine compound, a resin binder and a coupling agent, applying it onto a substrate and drying. The same effect can be obtained by treating the surface of a photosensitive layer with a coupling agent. In that case, the treatment is carried out by applying a solution of a coupling agent dissolved in an organic solvent such as toluene onto a photosensitive layer formed in a usual manner, and drying it.

The concentration of the coupling agent in the solution is usually from 0.005 to 0.1% by weight. It is appropriate that the pick-up of the coupling agent is from about 0.01 to about 2.0% by weight based on the photosensitive layer on a dry basis.

If it is desired to stabilize the dispersibility of particles of the phthalocyanine compound, the surface treatment thereof with a hydroxyl group-containing polymer may be conducted simultaneously with or after the treatment of the particles with a coupling agent.

Use of an antioxidant is very effective in preventing the deterioration of photosensitive layers, since the antioxidant efficiently deactivates active species such as ozone and NOx. The antioxidant may be incorporated in a protective layer provided on the photosensitive layer. Also, the incorporation of the antioxidant may be adopted in combination with the above-mentioned treatment with a coupling agent, whereby the corona resistance of the photosensitive layer can be more effectively improved.

The content of the antioxidant in the photosensitive layer or the protective layer is from 0.01 to 5.0% by weight. The deterioration of the photosensitive layer can be effectively prevented without impairing characteristics of the photosensitive layer by using the antioxidant within the above range. If the amount of the antioxidant is too small, its function is not sufficiently exhibited, and if the amount is too much, the responsiveness is decreased.

Examples of the antioxidant used in the present invention are, for instance, an aromatic amine compound such as N,N'-diphenyl-p-phenylenediamine (DPPD), phenyl-α-naphthylamine or 4,4'-dioctyldiphenylamine; a compound having a dialkylhydroxyphenyl skeleton such as 1,3,5-trimethyl-2,4,6-tris(3,5-dibutyl-4-hydroxybenzyl)benzene, pentaerythrityl-tetrakis[3-(3,5-t-butyl-4-hydroxyphenyl) propionate], 1,6-hexane-diol-bis[3-(3,5-di-t-butyl-4-hydroxyphenyl)propionate], triethyleneglycol-bis[3-(3-t-butyl-5-methyl-4-hydroxyphenyl)propionate], 2,4-bis(n-octylthio)-6-(4-hydroxy-3,5-di-t-butylanilino)-1,3,5-triazine, 2,2-thio-diethylenebis[3-(3,5-di-t-butyl-4-hydroxyphenyl)propionate], octadecyl-3-(3,5-di-t-butyl-4-hydroxyphenyl)propionate, N,N'-hexamethylenebis(3,5-di-t-butyl-4-hydroxy-hydrocinnamamide), 3,5-di-t-butyl-4-hydroxy-benzylphosphonate-diethyl ester, tris(3,5-di-t-butyl-4-hydroxybenzyl)isocyanurate or 2,4-bis-[(octylthio) methyl]-o-cresol; other antioxidants which have been used as an additive for plastics and rubbers; an antioxidant such as α-tocopherol or ascorbic acid; β-carotene; bis (dimethylaminophenyl) (aminomethyldithion)nickel; dimethyl-, -cyclodextrin; and the like. The antioxidants may be used alone or in admixture thereof.

The corona resistance of the photosensitive layer can be improved also by treating its surface so as to make hydrophobic. Fluorine-containing compounds are effective as a treating agent for this treatment.

The treatment to make the surface of the photosensitive layer hydrophobic can be easily achieved, for example, by applying a solution of a fluorine-containing compound, typically a fluorine-containing resin soluble in a solvent, to the surface of the photosensitive layer, thereby covering the surface with the fluorine-containing compound. The fluorine-containing resin includes, for instance, a fluorinated epoxy resin such as 3-(perfluoro-5-methylhexyl)-1,2-epoxypropane, and hydrophobic polymers which contain a fluorine atom in its molecule and are soluble in a solvent. The thickness of the fluorine-containing resin film formed on the photosensitive layer is usually from 0.1 to 2 μm.

It is desirable that the protective layer to be provided on the photosensitive layer can be made as thin as possible so as not to decrease the photosensitivity, and is excellent in abrasion resistance so that a stable image quality is obtained even if the photosensitive member is repeatedly used.

In another aspect of the present invention, there is provided a protective layer which is improved in abrasion resistance without decreasing electrophotographic characteristics such as chargeability, photosensitivity, dark attenuation and digitalization adaptability.

Such a protective layer is formed from a ultraviolet-curable acrylic resin, or a mixture of a polyester resin and a butylated melamine resin. The butylated melamine resin is a butanol-modified melamine resin obtained by reacting melamine with formaldehyde, and etherifying the methylol group of the resulting methylolmelamine with butyl alcohol.

As the UV-curable acrylic resin, there can be used known UV-curable acrylic resins composed of a photopolymerizable prepolymer, a photopolymerizable monomer and a photoinitiator. For example, commercially available UV-curable acrylic resins such as Unidec CI-840, Unidec 17-824-9 and Grandic 601 (which are products of Dainippon Ink and Chemicals, Inc.) can be utilized in the present invention.

As the mixture of polyester resin and butylated melamine resin, there can be utilized so-called melamine-alkyd resins composed of an alkyd resin and a butanol-modified melamine resin.

The mixing ratio of the polyester resin to the butylated melamine resin is usually from 60:40 to 90:10 by weight. The polyester-melamine resin is a thermosetting resin, and the backing is usually conducted at a temperature of 120° to 220° C. for 10 to 240 minutes.

The thickness of the protective layer formed from the above-mentioned curable resins is usually from 0.1 to 2.0 μm. If the thickness is less than 0.1 μm, mechanical properties, e.g. printing durability, is markedly decreased. If the thickness is more than 2.0 μm, the light response speed becomes insufficient, resulting in decrease of the basic performance of photosensitive members.

The abrasion resistance is also improved by polishing the surface of a photosensitive layer containing photoconductive phthalocyanine compound dispersed in a binder resin with a solvent to smoothen the surface, and then providing a protective layer on the polished surface, since the frictional resistance of the surface of the photosensitive layer is decreased.

A resin layer having a low electric resistance provided as a protective layer for a photosensitive layer or provided as an intermediate layer between a protective layer and a photosensitive layer enables to increase the thickness of the protective layer without decreasing the photosensitivity of photosensitive members, and also can protect the photosensitive layer from charge on a transfer medium in an electrophotography using a contact type intermediate transfer medium.

Thus, in a still another aspect, the present invention also provides a photosensitive member for electrophotography comprising a low resistance layer having a volume resistivity of $10^{10}$ to $10^{15}$ Ω.m disposed on a photosensitive layer.

When the low resistance layer is provided as a protective layer on a photosensitive layer, this protective layer can be formed thick without decreasing the photosensitivity, thus the performances required for protective layers can be sufficiently achieved and a stable image quality is obtained in repeated use Also, when the low resistance layer is provided as the protective layer or as the intermediate layer, good transfer can be achieved even if the photosensitive member is used in an electrophotographic recording apparatus having a contact type intermediate transfer medium, since a negative bias owing to the intermediate transfer medium can be blocked by the low resistance layer. This transfer system is utilized in superimposing different colored toner images, so the photosensitive member according to this embodiment can be used satisfactorily used in a color recording apparatus.

It is important that the low resistance layer useful as a protective layer or charge-blocking layer for the photosensitive member has a volume resistivity of $10^{10}$ to $10^{15}$ Ω.cm. If the volume resistivity is less than $10^{10}$ Ω.cm, charge retention becomes insufficient, so an electrostatic latent image having a high resolution is not obtained and the recorded image is blurred. If the volume resistivity is more than $10^{15}$ Ω.cm, the residual voltage becomes high, so the recording concentration becomes thin.

The low resistance layer is formed from a polyamide resin alone such as a nylon 6/66/610/12 copolymer, or a resin containing at least one metal oxide selected from the group consisting of tin oxide, antimony oxide, indium oxide and titanium oxide. Examples of the polyamide are, for instance, nylon 6, nylon 66, nylon 69, nylon 612, nylon 6T, nylon 11, nylon 12 and copolyamides such as nylon 6/66/610/12 copolymer. The resins to be incorporated with the metal oxide are preferably polyamides mentioned above and thermosetting resins such as a polyester-melamine resin as mentioned above, although other resins as conventionally used in a protective layer may be used.

The volume resistivity of the obtained resin layer can be suitably adjusted by adding at least one metal oxide powder selected from the group consisting of tin oxide, antimony oxide, indium oxide and titanium oxide to a resin, preferably a polyamide or a thermosetting resin. The content of the metal oxide in the low electric resistance layer is suitably selected so that the volume resistivity of the obtained layer falls within the range of $10^{10}$ to $10^{15}$ Ω.cm. Although the content varies depending on the kinds of the resin used and the metal oxide, it is usually from 0.1 to 10% by weight, especially 0.5 to 3% by weight.

It is desirable that the low resistance layer is as thick as possible. Since the decrease of photosensitivity does not occur, it is possible to form the layer in a thickness of at least 1–2 μm, provided that the thickness should be at most 5 μm, since a problem of increase in residual voltage is apt to occur if the layer is too thick.

The low resistance layer is formed by dissolving a polyamide in a suitable solvent and coating the resulting solution onto the surface of a photosensitive layer in a usual manner, or by dissolving a resin in a suitable solvent, adding a metal oxide powder to the resulting solution, mixing or milling it in a grinding machine or the like, and coating the resulting dispersion onto the surface of a photosensitive layer in a usual manner.

The present invention is more specifically described and explained by means of the following Examples, wherein all % are by weight unless otherwise noted. It is to be understood that the present invention is not limited to these Examples.

EXAMPLE 1

A polished aluminum substrate was coated with a 5% methanol solution of a polyamide (commercially available under the trade mark "CM-8000" made by Toray Industries, Inc.) in a dipping manner, and dried at 100° C. for 30 minutes to form an undercoat layer having an average thickness of 0.5 μm.

To 1,300 g of toluene were added 150 g of X-form metal-free phthalocyanine particles (commercially available under the trade mark "Fastogen Blue 8120 BS" made by Dainippon Ink and Chemicals, Inc.) and 0.1% of polyvinyl butyral (commercially available under the trade mark "Eslec BM-S" made by Sekisui Chemical Co., Ltd.) based on the phthalocyanine particles. They were mixed for 2 hours in a paint shaker to give a dispersion of phthalocyanine particles treated with a hydroxyl group-containing polymer (polyvinyl butyral).

To the dispersion were added 279 g of a polyester resin (commercially available under the trade mark "Armatex P-645" made by Mitsui Toatsu Chemicals, Inc.), 70 g of a butylated melamine resin (commercially available under the trade mark "Uban 20-HS" made by Mitsui Toatsu Chemicals, Inc.) and 1,300 g of methyl ethyl ketone, and were mixed for 2 hours in a paint shaker to give a photosensitive liquid.

The thus prepared photosensitive liquid was applied to the aluminum substrate having the undercoat layer in a dipping manner, dried at 25° C. for 60 minutes and baked at 150° C. for 4 hours to form a photosensitive layer having a thickness of 18 to 22 μm.

A toluene solution containing the polyester resin (Armatex P-645 made by Mitsui Toatsu Chemicals, Inc.) in a concentration of 24% and the butylated melamine resin (Uban 20-HS made by Mitsui Toatsu Chemicals, Inc.) in a concentration of 6% was then applied onto the photosensitive layer in a dipping manner, dried and baked at 150° C. for 4 hours to form a protective layer having a thickness of 0.5 to 1 μm, thus giving a photosensitive member for electrophotographic use.

A cylindrical photosensitive member was further prepared in the same manner as above using an aluminum drum as a substrate.

The photosensitive liquid and the photosensitive members were tested as follows:

The results are shown in Table 1.

Precipitation in photosensitive liquid

A photosensitive liquid was allowed to stand in a dark room, and was visually observed with respect to days until precipitation occurred.

Agglomeration of particles

A photosensitive liquid immediately after the preparation was observed by a scanning electron microscope (JSM-T330A made by JEOL LTD., resolution 4.5 nm) at X35,000 magnification with respect to presence or absence of agglomerated particles.

Dark attenuation

A photosensitive member was charged at +600 V, and the potential of charge was measured 1 second after stopping the charging to determine the variation, using an electrostatic electrification testing apparatus (EPA-8 100 made by Kawaguchi Denki Kabushiki Kaisha).

Void in image

Black full printing was conducted on a white paper using a printer made on an experimental basis, and it was visually observed whether there was voids (non-printed spots) or not.

Black spot in image

White full printing was conducted on a white paper using a printer made on an experimental basis, and it was visually observed whether there was black spots or not.

High temperature high humidity test

The printing tests were made at 35° C. and 80% RH.

Responsiveness

Using an electrostatic electrification testing apparatus (EPA-8 100 made by Kawaguchi Denki Kabushiki Kaisha), a photosensitive member was charged at about +600 V and was irradiated with a light having a wavelength of 780 nm in an exposure amount of 2.5 $\mu J/cm^2$, and the variation of the charge potential was measured 0.2 second, 0.5 second and 1.0 second after the irradiation.

EXAMPLES 2 TO 4

Photosensitive members for electrophotography were prepared in the same manner as in Example 1 except that the hydroxyl group-containing polymer, polyvinyl butyral, was used in an amount of 1%, 10% or 50% based on the X-form metal-free phthalocyanine.

The results are shown in Table 1.

EXAMPLE 5

A photosensitive member for electrophotography was prepared in the same manner as in Example 1 except that polyvinyl acetal (commercially available under the trade mark "Eslex KS-1" made by Sekisui Chemical Co., Ltd.) was used as a hydroxyl group-containing polymer in an amount of 2% based on the phthalocyanine particles instead of polyvinyl butyral.

The results are shown in Table 1.

EXAMPLE 6

A photosensitive member for electrophotography was prepared in the same manner as in Example 1 except that polyvinyl formal was used as a hydroxyl group-containing polymer instead of polyvinyl butyral.

The results are shown in Table 1.

EXAMPLE 7

A photosensitive member for electrophotography was prepared in the same manner as in Example 1 except that in the step of treating the X-form metal-free phthalocyanine particles with polyvinyl butyral, 0.045 g of a silane coupling agent (commercially available under the trade mark "KBM-603" made by Shin-Etsu Chemical Co., Ltd.) was further added to toluene together with the phthalocyanine particles and polyvinyl butyral.

The results are shown in Table 1.

Reference Example 1

The procedure of Example 1 was repeated except that the hydroxyl group-containing polymer, polyvinyl butyral, was not used.

The results are shown in Table 1.

TABLE 1

| | Ex. 1 | Ex. 2 | Ex. 3 | Ex. 4 | Ex. 5 | Ex. 6 | Ex. 7 | Ref. Ex. 1 |
|---|---|---|---|---|---|---|---|---|
| Photosensitive layer | | | | | | | | |
| Phthalocyanine compound: A (g) | 150 | 150 | 150 | 150 | 150 | 150 | 150 | 150 |
| OH-containing compound: B (g) | 0.15 | 1.5 | 15 | 75 | 3 | 7.5 | 1.5 | — |
| (B/A) × 100 (%) | 0.1 | 1 | 10 | 50 | 2 | 5 | 1 | — |
| Silane coupling agent (g) | — | — | — | — | — | — | 0.045 | — |
| Solvent (g) | 1300 | 1300 | 1300 | 1300 | 1300 | 1300 | 1300 | 1300 |
| Binder resin (g) | 349 | 349 | 349 | 349 | 349 | 349 | 349 | 349 |
| Additional solvent (g) | 1300 | 1300 | 1300 | 1300 | 1300 | 1300 | 1300 | 1300 |
| Protective layer | | | | | | | | |
| Resin (%) | 30 | 30 | 30 | 30 | 30 | 30 | 30 | 30 |
| Solvent (%) | 70 | 70 | 70 | 70 | 70 | 70 | 70 | 70 |
| Test results | | | | | | | | |
| Precipitation | None after 7 days | None after 7 days | None after 7 days | None after 7 days | None after 7 days | None after 7 days | None after 7 days | Observed after 1 day |
| Agglomeration of particles | None | None | None | None | None | None | None | Observed |
| Dark attenuation (V/sec) | 3 | 2 | 5 | 7 | 5 | 8 | 5 | 5 |
| Image quality | | | | | | | | |
| Voids | None | None | None | None | None | None | None | Observed |
| Black spots | None | None | None | None | None | None | None | Observed |
| At high temp. high humidity | Good | Good | Good | Good | Good | Good | Good | Good |
| Responsiveness | | | | | | | | |
| Surface potential (V) | | | | | | | | |
| initial | 605 | 610 | 605 | 615 | 600 | 610 | 605 | 610 |
| after 0.2 sec. | 55 | 55 | 60 | 50 | 70 | 65 | 60 | 55 |

TABLE 1-continued

| | Ex. 1 | Ex. 2 | Ex. 3 | Ex. 4 | Ex. 5 | Ex. 6 | Ex. 7 | Ref. Ex. 1 |
|---|---|---|---|---|---|---|---|---|
| after 0.5 sec. | 8 | 10 | 5 | 7 | 15 | 10 | 18 | 15 |
| after 1 sec. | 8 | 10 | 5 | 7 | 15 | 10 | 18 | 15 |

From the results shown in Table 1, it is found that the photosensitive liquids of Examples 1 to 7 containing particles of a phthalocyanine compound surface-treated with a hydroxyl group-containing polymer are significantly improved in stability and the photosensitive members obtained therefrom do not show dark attenuation and formation of voids and black spots in images and exhibit good electrophotographic characteristics under high temperature and humidity conditions and uniform electrophotographic characteristics over the entire of the photosensitive member, whereas the photosensitive liquid of Reference Example 1 prepared using a phthalocyanine compound and an alkyd-melamine resin binder without surface treatment of the phthalocyanine compound is inferior in dispersion stability.

EXAMPLE 8

A polyamide undercoat layer having an average thickness of 0.5 μm was formed on a polished aluminum plate in the same manner as in Example 1 to give a substrate.

To 130 g of toluene were added 15 g of X-form metal-free phthalocyanine particles and 0.015 g of N-β-(aminoethyl)-γ-aminopropyltrimethoxysilane (silane coupling agent commercially available under the trade mark "KBM-603" made by Shin-Etsu Chemical Co., Ltd.), and were milled for 2 hours by a paint shaker to treat the surface of the phthalocyanine particles with the silane coupling agent.

To the resulting dispersion were then added 27.9 g of a polyester resin (trade mark "Armatex P645" made by Mitsui Toatsu Chemicals, Inc.), 6.98 g of a butylated melamine resin (trade mark "Uban 20-HS" made by Mitsui Toatsu Chemicals, Inc.) and 130 g of methyl ethyl ketone, and were further milled for 2 hours to give a photosensitive liquid. The concentration of the silane coupling agent was 0.03% based on the solid matters of the photosensitive liquid. The thus obtained photosensitive liquid was applied onto the polyamide undercoat layer of the substrate by dipping, dried at room temperature and cured at 150° C. for 4 hours to form a photosensitive layer having a thickness of 18 to 22 μm.

A 30% toluene solution of the same polyester resin and butylated melamine resin as used above in a ratio of 4:1 by weight was applied onto the photosensitive layer by dipping and cured at 150° C. for 4 hours to form a protective layer.

The thus obtained photosensitive member was tested with respect to corona resistance, dark attenuation characteristic and responsiveness according to the following methods by using an electrostatic electrification testing apparatus (trade mark "EPA-8 100" made by Kawaguchi Denki Kabushiki Kaisha).

The results are shown in Table 2.

Corona resistance

A photosensitive member was subjected to corona charging continuously for 30 seconds at a constant current of +7 μA, and the potential (V) of charge was measured to determine the rate of variation to the initial potential of charge.

Dark attenuation

A photosensitive member was charged at +600 V, and the potential of charge was measured 1 second after stopping the charging to determine the variation.

Responsiveness

A photosensitive member was charged at about +600 V, and was irradiated with a light having a wavelength of 780 nm in an exposure amount of 3 $\mu J/cm^2$, and the variation of the potential was measured 0.2 second, 0.5 second and 1.0 second after the irradiation.

EXAMPLES 9 AND 10

The procedure of Example 8 was repeated except that the silane coupling agent was used in an amount of 0.04% (Example 9) or 0.16% (Example 10) based on the total weight of the solid matters included in the photosensitive liquid instead of 0.03%.

The results are shown in Table 2.

EXAMPLE 11

In this Example, the surface of a photosensitive layer was treated with a silane coupling agent.

A polyamide undercoat layer having an average thickness of 0.5 μm was formed on a polished aluminum plate in the same manner as in Example 1 to give a substrate.

A mixed solvent composed of 130 g of toluene and 130 g of methyl ethyl ketone was added to a mixture of 15 g of X-form metal-free phthalocyanine particles, 27.9 g of a polyester resin (trade mark "Armatex P645" made by Mitsui Toatsu Chemicals, Inc.) and 6.98 g of a butylated melamine resin (trade mark "Uban 20-HS" made by Mitsui Toatsu Chemicals, Inc.), and was milled by a paint shaker for 2 hours to give a photosensitive liquid. The thus obtained photosensitive liquid was applied onto the polyamide undercoat layer of the substrate by dipping, dried at room temperature and baked by heating at 150° C. for 1 hour to form a photosensitive layer having a thickness of 18 to 22 μm.

A toluene solution of N-β-(aminoethyl)-γ-aminopropyltrimethoxysilane (silane coupling agent commercially available under the trade mark "KBM-603" made by Shin-Etsu Chemical Co., Ltd.) was coated onto the photosensitive layer so that the amount of the silane coupling agent was 0.03% of the photosensitive layer on a dry basis. The coated layer was heated at 150° C. for 4 hours to dry and cure the layer, thus giving the photosensitive layer surface-treated with a silane coupling agent.

A 30% toluene solution of the same polyester resin and butylated melamine resin as used above in a ratio of 4:1 by weight was applied onto the thus treated photosensitive layer by dipping, and was dried and cured by heating at 150° C. for 4 hours to form a protective layer.

The thus obtained photosensitive member was tested in the same manner as in Example 8.

The results are shown in Table 2.

EXAMPLE 12

The procedure of Example 8 was repeated except that an intermediate layer of a polyamide (commercially available under the trade mark "CM-8000" made by Toray Industries, Inc.) was formed between the photosensitive layer and the protective layer.

The results are shown in Table 2.

EXAMPLE 13

The procedure of Example 8 was repeated except that the surface of the phthalocyanine particles was treated with a titanate coupling agent (commercially available under the trade mark "KR38S" made by Ajinomoto Co., Inc.), instead of the silane coupling agent, in an amount such that the concentration of the titanate coupling agent in the photosensitive layer was 0.05% based on the solid matters of the photosensitive liquid. The thickness of the photosensitive layer formed was 18 to 22 μm.

The results are shown in Table 2.

EXAMPLE 14

The procedure of Example 11 was repeated except the surface of the photosensitive layer was treated with a titanate coupling agent (trade mark "KR38S" made by Ajinomoto Co., Inc.) using a toluene solution thereof, instead of the toluene solution of silane coupling agent, in an amount such that the amount of the titanate coupling agent applied onto the photosensitive layer was 0.05% of the photosensitive layer on a dry basis. The thickness of the photosensitive layer formed was 18 to 22 μm.

The results are shown in Table 2.

EXAMPLE 15

In this Example, an antioxidant was incorporated into the photosensitive layer obtained in Example 8 wherein particles of a photoconductive phthalocyanine compound treated with a coupling agent were dispersed in a binder resin.

The same substrate as prepared in Example 8 was used.

To 130 g of toluene were added 15 g of X-form metal-free phthalocyanine particles and 0.015 g of N-β-(aminoethyl)-γ-aminopropyltrimethoxysilane (silane coupling agent commercially available under the trade mark "KBM-603" made by Shin-Etsu Chemical Co., Ltd.), and were milled for 2 hours by a paint shaker to treat the surface of phthalocyanine particles with the silane coupling agent.

To the resulting dispersion were then added 27.9 g of a polyester resin (trade mark "Armatex P645" made by Mitsui Toatsu Chemicals, Inc.), 6.98 g of a butylated melamine resin (trade mark "Uban 20-HS" made by Mitsui Toatsu Chemicals, Inc.), 0.03 g of N,N'-diphenyl-p-phenylenediamine (antioxidant), 130 g of methyl ethyl ketone and 390 g of toluene, and were further milled for 2 hours to give a photosensitive liquid. The concentrations of the silane coupling agent and the antioxidant in the photosensitive layer were 0.03% and 0.06%, respectively, based on the solid matters. The thus obtained photosensitive liquid was applied onto the polyamide undercoat layer of the substrate by dipping, dried at room temperature and cured at 150° C. for 4 hours to form a photosensitive layer having a thickness of 18 to 22 μm.

A 30% toluene solution of the same polyester resin and butylated melamine resin as used above in a ratio of 4:1 by weight was applied onto the photosensitive layer by dipping and cured by heating at 150° C. for 4 hours to form a protective layer.

The test results of the obtained photosensitive member are shown in Table 2.

EXAMPLE 16

The procedure of Example 15 was repeated except that the antioxidant was used in a concentration of 0.5% based on the solid matters of the photosensitive liquid instead of 0.06%.

The results are shown in Table 2.

EXAMPLE 17

The procedure of Example 15 was repeated except that 0.005 g of α-tocopherol was used as an antioxidant instead of 0.03 g of N,N'-diphenyl-p-phenylenediamine. The amount of a -tocopherol was 0.01% based on the solid matters of the photosensitive liquid.

The results are shown in Table 2.

EXAMPLE 18 TO 20

The procedure of Example 15 was repeated except that β-carotin (Example 18), ascorbic acid (Example 19) or bis(dimethylaminophenyl) (aminomethyldithion)nickel (Example 20), which were an active oxygen quencher, was incorporated into the photosensitive liquid in an amount of 0.01%, 0.01% or 2%, respectively, based on the solid matters of the obtained photosensitive liquid, instead of the antioxidant N,N'-diphenyl-p-phenylenediamine.

The results are shown in Table 2.

EXAMPLE 21

A photosensitive member having a photosensitive layer containing an antioxidant and surface-treated with a coupling agent was prepared as follows:

The same substrate as prepared in Example 8 was used.

To a mixed solvent of 130 g of toluene and 130 g of methyl ethyl ketone were added 15 g of X-form metal-free phthalocyanine particles, 0.005 g of ascorbic acid, 0.5 g of dimethyl-β-cyclodextrin, 27.9 g of a polyester resin (trade mark "Armatex P645" made by Mitsui Toatsu Chemicals, Inc.) and 6.98 g of a butylated melamine resin (trade mark "Uban 20-HS" made by Mitsui Toatsu Chemicals, Inc.), and were milled by a paint shaker for 2 hours to give a photosensitive liquid. The thus obtained photosensitive liquid was applied onto the polyamide undercoat layer of the substrate by dipping, dried at room temperature and cured at 150° C. for 1 hour to form a photosensitive layer having a thickness of 18 to 22 μm.

A 0.01% toluene solution of a silane coupling agent (trade mark "KBM-603" made by Shin-Etsu Chemical Co., Ltd.) was coated onto the photosensitive layer. The coated layer was heated at 150° C. for 1 hour to dry and cure the layer, thus giving the photosensitive layer surface-treated with a silane coupling agent.

A 30% toluene solution of the same polyester resin and butylated melamine resin as used above in a ratio of 4:1 by weight was applied onto the photosensitive layer by dipping and cured by heating at 150° C. for 4 hours to form a protective layer.

The results are shown in Table 2.

EXAMPLE 22

In this Example, a protective layer containing an antioxidant was provided on a photosensitive layer.

The same substrate as prepared in Example 8 was used.

A mixture of 15 g of X-form metal-free phthalocyanine, 27.9 g of a polyester resin (trade mark "Armatex P645"

made by Mitsui Toatsu Chemicals, Inc.), 6.98 g of a butylated melamine resin (trade mark "Uban 20-HS" made by Mitsui Toatsu Chemicals, Inc.), 130 g of toluene and 130 g of methyl ethyl ketone was milled by a paint shaker made by Asada Tekko Kabushiki Kaisha to give a photosensitive liquid. The liquid was then coated onto the substrate by dipping, and cured at 150° C. for 4 hours to form a photosensitive layer having a thickness of 18 to 22 μm.

A toluene solution containing 0.5% of 1,3,5-trimethyl-2,4,6-tris(3,5-dibutyl-4-hydroxybenzyl)benzene (melting point 240° to 245° C. ) which was an antioxidant compound having a dialkylhydroxyphenyl skeleton, 4.8% of the same polyester resin as above and 1.2% of the same butylated melamine resin as above was coated onto the photosensitive layer and thermally cured to form a protective layer having a thickness of about 1 μm The test results of the obtained photosensitive member are shown in Table 2.

EXAMPLE 23

A photosensitive member was prepared in the same manner as in Example 22 except that an intermediate layer of a polyamide (commercially available under the trade mark "CM8000" made by Toray Industries, Inc.) was formed between the photosensitive layer and the protective layer.

The results are shown in Table 2.

EXAMPLE 24

The procedure of Example 22 was repeated except that a protective layer was formed from a 6% toluene solution of an epoxy resin composed of Epikote #815 and Epomate B002 (products of Yuka Shell Kabushiki Kaisha) in a ratio of 2:1 by weight to which was added 0.5% of pentaerythrityl-tetrakis[3-(3,5-di-t-butyl-4-hydroxyphenyl) propionate] (melting point 117° to 125° C.) which was an antioxidant compound having a dialkylhydroxyphenyl skeleton.

The results are shown in Table 2.

EXAMPLE 25

The procedure of Example 22 was repeated except that 1,6-hexanediol-bis[3-(3,5-di-t-butyl-4-hydroxyphenyl) propionate]was used as an antioxidant to be included in the protective layer in an amount of 1% based on the weight of the protective layer and an intermediate layer of a polyamide (trade mark "CM8000" made by Toray Industries, Inc.) was formed between the photosensitive layer and the protective layer.

The results are shown in Table 2.

EXAMPLE 26

The procedure of Example 22 was repeated except that the protective layer was formed from a toluene solution containing 0.01% of β-carotin, 4.8% of the polyester resin and 1.2% of the burtylated melamine resin.

The results are shown in Table 2.

EXAMPLE 27

In this Example, the surface of a photosensitive layer was treated with a fluorine-containing compound to make it hydrophobic.

The same substrate as prepared in Example 8 was used.

A mixture of 15 g of X-form metal-free phthalocyanine, 27.9 g of a polyester resin (trade mark "Armatex P645" made by Mitsui Toatsu Chemicals, Inc.), 6.98 g of a butylated melamine resin (trade mark "Uban 20-HS" made by Mitsui Toatsu Chemicals, Inc.), 130 g of toluene and 130 g of methyl ethyl ketone was milled by a paint shaker for 2 hours to give a photosensitive liquid. The liquid was then coated onto the polyamide surface of the substrate by dipping, dried at room temperature and cured at 150° C. for 1 hour to form a photosensitive layer having a thickness of 18 to 22 μm.

To the photosensitive layer was applied 3-(perfluoro-5-methylhexyl)-1,2-epoxypropane (fluorine-containing epoxy resin commercially available under the trade mark "E-3630" made by Daikin Industries, Ltd.) in an amount of 0.2% based on the photosensitive layer, and was cured at 150° C. for 4 hours to give a photosensitive member.

The test results are shown in Table 2.

Reference Example 2

In order to estimate the treatment with a coupling agent as conducted in Examples 8 to 11 and 13 to 21, a photosensitive member not subjected to the coupling agent treatment was prepared as follows:

A polyamide undercoat layer having an average thickness of 0.5 μm was formed on a polished aluminum plate in the same manner as in Example 1 to give a substrate.

To a mixed solvent of 130 g of toluene and 130 g of methyl ethyl ketone were added 15 g of X-form metal-free phthalocyanine particles, 27.9 g of a polyester resin (Armatex P645) and 6.98 g of a butylated melamine resin (Uban 20-HS), and the resulting mixture was milled for 2 hours by a paint shaker to give a photosensitive liquid. The obtained photosensitive liquid was coated onto the polyamide undercoat layer of the substrate by dipping, dried at room temperature and cured at 150° C. for 4 hours to form a photosensitive layer having a thickness of 18 to 22 μm.

A 30% toluene solution of the same polyester resin and butylated melamine resin as used above in a ratio of 4:1 by weight was applied onto the photosensitive layer by dipping, and cured at 150° C. for 4 hours to form a protective layer.

The results are shown in Table 2.

Reference Example 3

In order to estimate the photosensitive members having an intermediate layer obtained in Examples 12 and 23, a photosensitive member having an intermediate layer was prepared in the same manner as in Reference Example 2 except that an intermediate layer of a polyamide (CM-8000) was formed between the photosensitive layer and the protective layer by dip-coating a 1.0% methanol solution of the polyamide onto the photosensitive layer and drying at 100° C. for 30 minutes.

The results are shown in Table 2.

Comparative Example 1

In order to estimate the photosensitive member having an epoxy resin protective layer containing an antioxidant obtained in Example 24, a photosensitive member was prepared in the same manner as in Example 24 except that the antioxidant was not incorporated in the epoxy resin protective layer.

The results are shown in Table 2.

TABLE 2

| | Corona resistance (Rate of variation of surface potential due to corona irradiation) (%) | Dark attenuation (V/sec.) | Responsiveness (Surface potential) (V) Initial | After 0.2 sec. | After 0.5 sec. | After 1.0 sec. |
|---|---|---|---|---|---|---|
| Ex. 8 | 20 | 3 | 650 | 50 | 10 | 10 |
| Ex. 9 | 15 | 5 | 650 | 70 | 20 | 20 |
| Ex. 10 | 5 | 7 | 650 | 100 | 50 | 50 |
| Ex. 11 | 25 | 3 | 650 | 70 | 20 | 20 |
| Ex. 12 | 10 | 5 | 650 | 100 | 30 | 30 |
| Ex. 13 | 20 | 3 | 650 | 50 | 10 | 10 |
| Ex. 14 | 20 | 5 | 650 | 70 | 20 | 20 |
| Ex. 15 | 10 | 3 | 650 | 80 | 30 | 30 |
| Ex. 16 | 7 | 5 | 650 | 100 | 50 | 5G |
| Ex. 17 | 10 | 5 | 650 | 100 | 50 | 50 |
| Ex. 18 | 10 | 5 | 650 | 100 | 50 | 50 |
| Ex. 19 | 10 | 5 | 650 | 100 | 50 | 50 |
| Ex. 20 | 10 | 5 | 650 | 100 | 50 | 50 |
| Ex. 21 | 10 | 5 | 650 | 100 | 50 | 50 |
| Ex. 22 | 10 | 5 | 650 | 100 | 50 | 50 |
| Ex. 23 | 15 | 7 | 650 | 80 | 30 | 30 |
| Ex. 24 | 10 | 5 | 650 | 100 | 50 | 50 |
| Ex. 25 | 10 | 5 | 650 | 100 | 50 | 50 |
| Ex. 26 | 10 | 5 | 650 | 100 | 50 | 50 |
| Ex. 27 | 20 | 5 | 650 | 70 | 20 | 20 |
| Ref. Ex. 2 | 50 | 7 | 650 | 50 | 20 | 20 |
| Ref. Ex. 3 | 50 | 7 | 650 | 70 | 20 | 20 |
| Comp. Ex. 1 | 50 | 7 | 650 | 120 | 70 | 70 |

From the results shown in Table 2, it would be understood that the corona resistance of photosensitive members is improved without impairing dark attenuation and responsiveness by the treatment with a coupling agent, or the treatment to make hydrophobic, or the incorporation of an antioxidant.

EXAMPLE 28

A methanol solution of a polyamide (trade mark "CM-8000", product of Toray Industries, Inc.) was dip-coated onto a polished aluminum drum, and dried at 100° C. for 30 minutes to form an undercoat layer having an average thickness of 0.5 $\mu$m.

A mixture of 567 g of X-form metal-free phthalocyanine particles, 1055 g of a polyester resin (trade mark "Armatex P-645", product of Mitsui Toatsu Chemicals, Inc.), 264 g of a butylated melamine resin (trade mark "Uban 20-HS", product of Mitsui Toatsu Chemicals, Inc.), 3000 g of toluene and 9000 g of methyl ethyl ketone was milled by a basket mill. The resulting photosensitive liquid was dip-coated onto the polyamide undercoat layer, and cured at 150° C. for 4 hours to form a photosensitive layer.

To 2000 g of a 5% methanol solution of a polyamide (commercially available under the trade mark "824P" made by Toray Industries, Inc.) were added 5.0 g of $SnO_2$ and 5.0 g of $SbO_2$, and mixed to give a dispersion for forming a low electric resistance layer. The dispersion was coated onto the photosensitive layer and dried to form a low resistant layer having a thickness of 2 $\mu$m serving as a protective layer. The volume resistivity of this layer was $5\times10^{10}$ Ω.cm.

The obtained photosensitive member was set in a printer equipped with a surface electrometer, and the initial characteristics thereof were evaluated.

The results of the measurement of initial characteristics are shown in FIG. 1.

EXAMPLE 29

A photosensitive member was prepared in the same manner as in Example 28 except that $SnO_2$ and $SbO_2$ were used in amounts of 0.1 g and 0.1 g, respectively, to form a polyamide protective layer having a thickness of 2 $\mu$m and a volume resistivity of $8\times10^{14}$ Ω.cm.

The results are shown in FIG. 1.

Comparative Examples 2 to 5

The procedure of Example 28 was repeated except that the amounts of $SnO_2$ and $SbO_2$ were changed to form a polyamide protective layer having a volume resistivity of $2\times10^{9}$ Ω.cm (Comparative Example 2), a protective layer having a thickness of 2 $\mu$m and a volume resistivity of $1\times10^{16}$ Ω.cm was formed from a butyral resin conventionally used in the protective layer (Comparative Example 3), the protective layer of butyral resin was formed in a thickness of 0.3 $\mu$m (Comparative Example 4), or no protective layer was formed (Comparative Example 5).

The results are shown in FIG. 1.

In FIG. 1, it is observed that the photosensitive members having a low resistant protective layer of Examples 28 and 29 and the photosensitive member having no protective layer of Comparative Example 5 have good initial characteristics such as light responsiveness, but the photosensitive member of Comparative Example 2 is low in surface potential and has no sufficient chargeability.

It is also observed that when a conventional protective layer having a high electric resistance is used (Comparative Example 3), the residual potential is high and accordingly the light responsiveness is poor, and in order to realize a good light responsiveness, such a protective layer must be formed as thin as 0.3 $\mu$m or less (Comparative Example 4).

Then, with respect to only photosensitive members having good initial characteristics, they were used repeatedly and the characteristics were evaluated as follows:

A cycle of steps of charging a photosensitive member at 600 V, removing the charge by an erase light and applying a voltage of 700 V to the back side of an intermediate transfer belt in the state that the photosensitive member was in contact with the transfer belt was continuously repeated 10,000 times. After elapse of a night, the same operation was repeated 10,000 times, and after elapse of a night, the same operation was further repeated 10,000 times, thus 30,000 cycles in total. The residual potential and dark attenuation of the photosensitive member were then measured.

Further, printing was conducted using the thus operated photosensitive member under ordinary temperature and humidity conditions (25° C., 55%) and under higher temperature and humidity conditions (35° C., 80%), and the image quality of the prints was evaluated.

The results of measurement of characteristics after repeated use are shown in Table 3.

TABLE 3

| | Protective layer | Electric resistance (Q ~ cm) | Thickness of layer (μm) | Image quality |
|---|---|---|---|---|
| Ex. 28 | Polyamide, $SnO_2$, $SbO_2$ | $5 \times 10^{10}$ | 2 | good |
| Ex. 29 | Polyamide, $SnO_2$, $SbO_2$ | $8 \times 10^{14}$ | 2 | good |
| Com. Ex. 4 | Polyvinyl butyral | $1 \times 10^{16}$ | 0.3 | fog |
| Com. Ex. 5 | None | — | — | fog |

From the results shown in Table 3, it is understood that the photosensitive members of Examples 28 and 29 according to the present invention can perform good recording even after repeated use of 30,000 cycles, but the photosensitive members having a butyral resin protective layer (Comparative Example 4) and having no protective layer (Comparative Example 5) are poor in durability and satisfactory recording is not conducted because of generation of fog.

It would be understood that the reasons why good results are obtained according to the present invention are that since the protective layer can be made thick, its life has been prolonged, and a polyamide which can block a charge from a transfer belt, has been used as a polymer for forming a protective layer.

It would also be understood that the butyral resin protective layer must be formed thin from the viewpoint of light sensitivity and, therefore, is easily worn away in a short term, and that the butyral resin protective layer has no blocking function to negative charge from a transfer belt.

EXAMPLE 30

A photosensitive layer was formed on the substrate in the same manner as in Example 28.

A 1% methanol solution of a nylon 6/66/610/12 copolymer was applied onto the photosensitive layer to form a low resistant layer having a thickness of 0.5 μm and a volume resistivity of $5 \times 10^{14}$ Ω.cm as an intermediate layer.

A 6% toluene solution of the same polyester resin and butylated melamine resin as used for the photosensitive layer in a ratio of 4:1 by weight was applied onto the low resistant layer, dried and cured at 150° C. for 4 hours to form a protective layer having a thickness of 1 μm.

The thus obtained photosensitive member was evaluated in the same manner as above with respect to the characteristics after repeated use such as residual potential, dark attenuation and image quality.

The results are shown in Table 4.

EXAMPLE 31

The procedure of Example 30 was repeated except that a polyamide (commercially available under the trade mark "CM842" made by Toray Industries, Inc.) was used instead of the nylon 6/66/610/12 copolymer.

The results are shown in Table 4.

EXAMPLE 32

The procedure of Example 30 was repeated except that a polyamide (commercially available under the trade mark "CM831" made by Toray Industries, Inc.) was used instead of the nylon 6/66/610/12 copolymer.

The results are shown in Table 4.

EXAMPLE 33

The procedure of Example 30 was repeated except that a polyamide (commercially available under the trade mark "CM4000" made by Toray Industries, Inc.) was used instead of the nylon 6/66/610/12 copolymer.

The results are shown in Table 4.

EXAMPLE 34

The procedure of Example 30 was repeated except that a low resistant intermediate layer containing 3% of $InO_2$ and 3% of $TiO_2$ was formed using the same polyester resin and butylated melamine resin as used in the photosensitive layer instead of the nylon 6/66/610/12 copolymer.

The results are shown in Table 4.

Reference Examples 4 and 5

The procedure of Example 30 was repeated except that the protective layer of the polyester-melamine resin having a thickness of 1.0 μm was formed directly on the photosensitive layer without forming the low resistant intermediate layer (Reference Example 4), or a protective layer of a UV-curable acrylic resin having a thickness of 1.0 μm was formed directly on the photosensitive layer without forming the low resistant intermediate layer (Reference Example 5).

The results are shown in Table 4.

TABLE 4

| | Characteristics after repeated use | | | |
|---|---|---|---|---|
| | Residual potential | Dark attenuation | Image quality | |
| | (V) | (V/sec.) | at 25° C., 55% RH | at 35° C., 80% RH |
| Example 30 | 60 | 10 | good | good |
| Example 31 | 35 | 20 | good | good |
| Example 32 | 68 | 13 | good | good |
| Example 33 | 64 | 9 | good | good |
| Example 34 | 58 | 14 | good | good |
| Reference Example 4 | 20 | 260 | fog | fog |
| Reference Example 5 | 36 | 195 | fog | fog |

It is observed in Table 4 that the photosensitive members having a low electric resistant layer show a low residual potential and a moderate dark attenuation even after repeated use, and as a result, show good recording characteristics both under ordinary temperature and humidity conditions and higher temperature and humidity conditions.

Although a layer of a polyester-melamine resin containing $InO_2$ and $TiO_2$ dispersed therein was used as a low resistant layer in Example 34, substantially the same results can be obtained by using layers of polyamide resins or other thermosetting resins containing at least one metal oxide selected from the group consisting of tin oxide, antimony oxide, indium oxide and titanium oxide.

EXAMPLES 35 TO 38

The procedure of Example 30 was repeated except that tetracyanoethylene was incorporated in the photosensitive layer in an amount of 0.05%, 0.5%, 1.0% or 2.0%.

The results are shown in Table 5 together with the results for Example 30.

TABLE 5

| | Amount of tetra- | Residual potential | Dark attenuation (V/sec.) | |
|---|---|---|---|---|
| | cyanoethylene (%) | (V) | at 25° C., 55% RH | at 35° C., 80% RH |
| Ex. 30 | 0 | 60 | 10 | 19 |
| Ex. 35 | 0.05 | 55 | 11 | 19 |
| Ex. 36 | 0.5 | 45 | 11 | 20 |
| Ex. 37 | 1.0 | 30 | 15 | 35 |
| Ex. 38 | 2.0 | 15 | 16 | 70 |

It is observed in Table 5 that the residual potential is decreased with increasing the amount of tetracyanoethylene. Thus, it would be understood that in photosensitive members having a photoconductive layer containing a phthalocyanine compound, the photosensitivity is improved by adding an electron acceptive compound to the photoconductive layer, and as a result, it is possible to form a protective layer in thick and stable image quality is obtained in use for a long term.

Although an electron acceptive compound was added to a photoconductive layer on which a low resistant intermediate layer and a protective layer of a thermosetting resin are provided in Examples 35 to 38, it is possible to decrease the residual potential, thus to obtain a sufficient photosensitivity, also with respect to photosensitive members having no low resistant intermediate or protective layer, by adding the electron acceptive compound such as tetracyanoethylene to the photoconductive layer thereof.

EXAMPLE 39

A polyamide undercoat layer was formed on a polished aluminum drum in the same manner as in Example 1 to give a substrate.

A mixture of 567 g of X-form metal-free phthalocyanine, 1,055 g of a polyester resin (trade mark "Armatex P645" made by Mitsui Toatsu Chemicals, Inc.), 264 g of a butylated melamine resin (trade mark "Uban 20-HS" made by Mitsui Toatsu Chemicals, In.), 3,000 g of toluene and 9,000 g of methyl ethyl ketone was milled by a basket mill to give a photosensitive liquid. The liquid was then coated onto the polyamide surface of the substrate by dipping, dried at room temperature and cured at 150° C. for 4 hours to form a photosensitive layer.

A 6% toluene solution of the same polyester resin and butylated melamine resin as above in a ratio of 7:3 by weight was applied onto the photosensitive layer and cured at 150° C for 4 hours to form a protective layer having an average thickness of 1.0 $\mu$m.

The thus obtained photosensitive member was subjected to a repeated printing test. An operation of a cycle consisting of positive charging, imagewise light exposure, development, transferring of the image and cleaning was repeated. A good printed image could be repeatedly obtained still after exceeding 30,000 cycles, thus it was confirmed that the abrasion resistance was very good.

Further, electric characteristics such as photosensitivity, dark attenuation and charge retainability of the photosensitive member subjected to the repeated printing test were measured in the initial stage (up to about 500 cycles) and after operation of 30,000 cycles. It was confirmed that the characteristics stood comparison with those of conventional photosensitive members.

These results are shown in Table 6.

EXAMPLE 40

The procedure of Example 39 was repeated except that the protective layer was formed in a thickness of 1.5 $\mu$m instead of 1.0 $\mu$m.

It was confirmed that the abrasion resistance was further improved as compared with Example 39, and the electric characteristics stood comparison with those of conventional photosensitive members.

EXAMPLE 41

The procedure of Example 39 was repeated except that a xylene solution of a UV curable acrylic resin (commercially available under the trade mark "Unidec CI-840" made by Dainippon Ink And Chemicals, Inc.) was dip-coated onto the photosensitive layer and cured by irradiation of ultraviolet rays to form a protective layer having an average thickness of 1.0 $\mu$m.

It was confirmed that good image could be repeatedly obtained even after operation of 30,000 cycles and the electric characteristics were also good. The results are shown in Table 6.

EXAMPLE 42

The procedure of Example 39 was repeated except that a xylene solution of a UV curable acrylic resin (commercially available under the trade mark "Unidec 17-824-9" made by Dainippon Ink And Chemicals, Inc.) was dip-coated onto the photosensitive layer and cured by irradiation of ultraviolet rays to form a protective layer having an average thickness of 1.0 $\mu$m.

It was confirmed that good image could be repeatedly obtained even after operation of 30,000 cycles and the electric characteristics were also good. The results are shown in Table 6.

EXAMPLE 43

The procedure of Example 39 was repeated except that a xylene solution of a UV curable acrylic-urethane resin (commercially available under the trade mark "Grandic 601" made by Dainippon Ink And Chemicals, Inc.) was dip-coated onto the photosensitive layer and cured by irradiation of ultraviolet rays to form a protective layer having an average thickness of 1.0 $\mu$m.

It was confirmed that good image could be repeatedly obtained even after operation of 30,000 cycles and the electric characteristics were also good. The results are shown in Table 6.

EXAMPLE 44

The procedure of Example 39 was repeated except that the surface of the photosensitive layer was polished with a cloth impregnated with toluene prior to forming a protective layer thereon.

It was confirmed that good image could be obtained in the repeated printing test even after operation of 30,000 cycles, and the abrasion resistance was further improved by polishing the surface of the photosensitive layer.

The polishing of a photosensitive layer with a solvent is effective for improving the abrasion resistance also in providing conventional protective layers on the photosensitive layer.

Comparative Examples 6 and 7

The procedure of Example 39 was repeated except that the protective layer was formed from a conventionally used silicone resin (commercially available under the Trade mark "TSE 3450" made by Toshiba Silicone Kabushiki Kaisha) (Comparative Example 6) or a conventionally used polycarbonate (commercially available under the trade mark "PCZ 4000" made by Mitsubishi Gas Chemical Company, Inc.) (Comparative Example 7).

The results are shown in Table 6.

The photosensitive member obtained in Comparative Example 6 showed electric characteristics on the same level as those of Examples 39 to 44 in the initial stage, but fog generated in the repeated printing test before operation of 20,000 cycles.

The photosensitive member obtained in Comparative Example 7 showed electric characteristics on the same level as those of Examples 39 to 44 in the initial stage, but showed decreased characteristics after operation of 30,000 cycles because of increase of dark attenuation. Also, good image, though slightly thin, was obtained up to operation of 20,000 cycles in the repeated printing test, but fog was observed in the prints before reaching 30,000 cycles, thus good image was not obtained any more.

TABLE 6

| | Image quality | | Electric characteristics | |
|---|---|---|---|---|
| | After 20000 cycles | After 30000 cycles | Initial stage | After 30000 cycles |
| Ex. 39 | excellent | excellent | excellent | excellent |
| Ex. 40 | excellent | excellent | excellent | excellent |
| Ex. 41 | excellent | excellent | excellent | excellent |
| Ex. 42 | excellent | excellent | excellent | excellent |
| Ex. 43 | excellent | excellent | excellent | excellent |
| Com. Ex. 6 | bad: fog | — | excellent | |
| Com. Ex. 7 | good | bad: fog | excellent | bad: increased dark attenuation |

In addition to the ingredients used in the Examples, other ingredients can be used in the Examples as set forth in the specification to obtain substantially the same results.

What we claim is:

1. A positively chargeable photosensitive member for electrophotography, comprising an electrically conductive support and a photosensitive layer including a dispersion-instable resin binder and 15 to 40% by weight, based on the total weight of said photosensitive layer, of particles of a photoconductive phthalocyanine compound dispersed in said binder, wherein the surfaces of said particles are coated with 0.1 to 10% by weight, based on said particles, of a hydroxyl group containing polymer.

2. The photosensitive member of claim 1, wherein said photoconductive phthalocyanine compound is X-form crystals of metal-free phthalocyanine.

3. The photosensitive member of claim 1, wherein said hydroxyl group-containing polymer is a polyvinyl acetal.

4. The photosensitive member of claim 3, wherein the polyvinyl acetal is selected from the group consisting of polyvinyl butyral, polyvinyl acetal itself, and polyvinyl formal.

5. The photosensitive member of claim 1, further comprising a charge-blocking layer formed on said photosensitive layer, said charge-blocking layer having a volume resistivity of $10^{10}$ to $10^{15}$ Ω.cm.

6. The photosensitive member of claim 5, wherein said charge-blocking layer is made of a polyamide.

7. The photosensitive member of claim 5, wherein said charge-blocking layer is a layer made of a polyamide or a thermosetting resin and containing at least one metal oxide selected from the group consisting of tin oxide, antimony oxide, indium oxide and titanium oxide in an amount sufficient to provide a volume resistivity of $10^{10}$ to $10^{15}$ Ω.cm.

8. The photosensitive member of claim 5, further comprising a protective layer formed on said charge-blocking layer.

9. The photosensitive member of claim 8, wherein said protective layer is made of a thermosetting resin consisting essentially of, on a 100% thermosetting resin basis, 60 to 90% by weight of a polyester resin and 10 to 40% by weight of a butylated melamine resin.

10. The photosensitive member of claim 1, further comprising a protective layer formed on said photosensitive layer.

11. The photosensitive member of claim 10, wherein said protective layer is made of a thermosetting resin consisting essentially of, on a 100% thermosetting resin basis, 60 to 90% by weight of a polyester resin and 10 to 40% by weight of a butylated melamine resin.

12. The photosensitive member of claim 1, wherein the dispersion-instable resin binder comprises polyester, polystyrene, polymethylmethacrylate, polyamide, styrene-acryl copolymer, styrene-acrylonitrile copolymer, or polyester-melamine.

13. The photosensitive member of claim 1, wherein the dispersion-instable resin binder comprises polyester-melamine resin.

14. The photosensitive member of claim 1, said photosensitive layer further including at least one member selected from the group consisting of an electron acceptive material, a coupling agent, and an antioxidant.

15. The photosensitive member of claim 14, wherein said electron acceptive material is a compound capable of forming a charge transfer complex with said phthalocyanine compound.

16. The photosensitive member of claim 14, wherein said electron acceptive material is at least one member selected from the group consisting of tetracyanoethylene, tetracyanoquinodimethane and trinitrofluorenone.

17. The photosensitive member of claim 14, wherein the surface of said particles of phthalocyanine compound is treated with said coupling agent.

18. The photosensitive member of claim 14, wherein said coupling agent is applied onto the surface of said photosensitive layer.

19. The photosensitive member of claim 14, wherein said coupling agent is at least one of silane coupling agents and titanate coupling agents.

20. The photosensitive member of claim 14, wherein said antioxidant is at least one member selected from the group consisting of an aromatic amine antioxidant, a compound having dialkylhydroxyphenyl skeleton, α-tocopherol, ascorbic acid, β-carotene, and dimethyl-β-cyclodextrin.

21. The photosensitive member of claim 20, wherein said antioxidant is bis(dimethylaminophenyl)(aminomethyldithion) nickel.

22. A positively chargeable photosensitive member for electrophotography, comprising an electrically conductive support and a photosensitive layer including a resin binder and particles of a photoconductive phthalocyanine compound dispersed in said binder, said photosensitive layer further including a coupling agent surface treated on said particles or applied over said layer, and bis(dimethylaminophenyl)(aminomethyldithion)nickel.

23. The photosensitive member of claim 22, wherein said binder is a thermosetting resin consisting essentially of at least one first member selected from the group consisting of a polyester resin, an acrylic resin, a urethane resin, a butyral resin and an epoxy resin with at least one second member selected from the group consisting of an amino resin and an isocyanate resin.

24. A positively chargeable photosensitive member for electrophotography comprising an electrically conductive support and a photosensitive layer including a resin binder and particles of a photoconductive phthalocyanine compound dispersed in said binder, said photosensitive layer further including at least one member selected from the group consisting of an electron acceptive material, a coupling agent, an antioxidant, and a hydroxyl group-containing polymer, and further comprising a protective layer formed on said photosensitive layer wherein said protective layer is made of a thermosetting resin consisting essentially of, on a 100% thermosetting resin basis, 60 to 90% by weight of a polyester resin and 10 to 40% by weight of a butylated melamine resin.

25. A positively chargeable photosensitive member for electrophotography, comprising an electrically conductive support and a photosensitive layer including (a) a resin binder and particles of a photoconductive phthalocyanine compound dispersed in said binder, said photosensitive layer further including at least one member selected from the group consisting of an electron acceptive material, a coupling agent, an antioxidant, and a hydroxyl group-containing polymer, (b) a charge-blocking layer formed on said photosensitive layer, said charge-blocking layer having a volume resistivity of $10^{10}$ to $10^{15}$ Ω.cm, and (c) a protective layer formed on the charge-blocking layer formed of a thermosetting resin consisting essentially of, on a 100% thermosetting resin basis, 60 to 90% by weight of a polyester resin and 10 to 40% by weight of a butylated melamine resin.

26. A positively chargeable photosensitive member for electrophotography, comprising an electrically conductive support, a photosensitive layer formed on said support, and a protective layer for said photosensitive layer, said protective layer being made of a thermosetting resin consisting essentially of, on a 100% thermosetting resin basis, 60 to 90% by weight of a polyester resin and 10 to 40% by weight of a butylated melamine resin.

27. The photosensitive member of claim 26, wherein said polyester resin is an alkyd resin.

28. The photosensitive member of claim 26, wherein said protective layer has a thickness of 0.1 to 2.0 μm.

29. The photosensitive member of claim 26, wherein said photosensitive layer comprises a resin binder and particles of a photoconductive phthalocyanine compound dispersed in said binder.

30. The photosensitive member of claim 29, wherein said photoconductive phthalocyanine compound is X-form crystals of metal-free phthalocyanine.

31. The photosensitive member of claim 29, wherein said binder is a thermosetting resin consisting essentially of at least one first member selected from the group consisting of a polyester resin, an acrylic resin, a urethane resin, a butyral resin and an epoxy resin with at least one second member selected from the group consisting of an amino resin and an isocyanate resin.

32. The photosensitive member of claim 26, further comprising a charge-blocking layer formed between said photosensitive layer and said protective layer, said charge-blocking layer having volume resistivity of $10^{10}$ to $10^{15}$ Ω.cm.

33. The photosensitive member of claim 32, wherein said charge-blocking layer is made of a polyamide.

34. The photosensitive member of claim 32, wherein said charge-blocking layer is a layer made of a polyamide or a thermosetting resin and containing at least one metal oxide selected from the group consisting of tin oxide, antimony oxide, indium oxide and titanium oxide in an amount sufficient to have a volume resistivity of $10^{10}$ to $10^{15}$ Ω.cm.

35. The photosensitive member of claim 26, wherein said protective layer contains a metal oxide in an amount sufficient to have a volume resistivity of $10^{10}$ to $10^{15}$ Ω.cm.

36. The photosensitive member of claim 35, wherein said metal oxide is at least one member selected from the group consisting of tin oxide, antimony oxide, indium oxide and titanium oxide.

37. The photosensitive member of claim 35, wherein said protective layer has a thickness of at most 5 μm.

38. A positively chargeable photosensitive member for electrophotography comprising an electrically conductive support and a photosensitive layer including a dispersion-instable resin binder and particles of a photoconductive phthalocyanine compound dispersed in said binder, the surfaces of said particles being entirely covered with a hydroxyl group-containing polymer to thereby increase the dispersion stability of said particles in said binder.

39. A positively chargeable photosensitive member for electrophotography comprising:

(a) an electrically conductive support;

(b) photosensitive layer placed on said support and including a dispersion-instable resin binder and particles of a photoconductive phthalocyanine compound dispersed in said binder, the surfaces of said particles being at least partially covered with a hydroxyl group-containing polymer to thereby increase the dispersion stability of said particles in said binder; and (c) a polyamide charge-blocking layer formed on said photosensitive layer and having a volume resistivity of $10^{10}$ to $10^{15}$ Ω.cm.

40. A positively chargeable photosensitive member for electrophotography comprising:

(a) an electrically conductive support;

(b) a photosensitive layer placed on said support and including a dispersion-instable resin binder and particles of a photoconductive phthalocyanine compound dispersed in said binder, the surfaces of said particles being at least partially covered with a hydroxyl group-containing polymer to thereby increase the dispersion stability of said particles in said binder;

(c) a charge-blocking layer formed on said photosensitive layer, said charge-blocking layer having a volume resistivity of $10^{10}$ to $10^{15}$ Ω.cm; and (d) a protective layer formed on said charge-blocking layer.

41. A positively chargeable photosensitive member for electrophotography comprising:

(a) an electrically conductive support;

(b) a photosensitive layer placed on said support and including a dispersion-instable resin binder and particles of a photoconductive phthalocyanine compound dispersed in said binder, the surfaces of said particles being at least partially covered with a hydroxyl group-containing polymer to thereby increase the dispersion stability of said particles in said binder;

(c) a protective layer formed on said photosensitive layer, said protective layer being made of a thermosetting resin consisting essentially of, on a 100% resin basis, 60 to 90% by weight of a polyester resin and 10 to 40% by weight of a butylated melamine resin.

42. A positively chargeable photosensitive member for electrophotography comprising an electrically conductive support and a photosensitive layer including:

(a) a dispersion-instable resin binder and 15 to 40% by weight, based on the total weight of said photosensitive layer, of particles of a photoconductive phthalocyanine compound dispersed in said binder, the surfaces of said particles being at least partially covered with 0.1 to 10% by weight, based on said particles, of a hydroxyl group-containing polymer to thereby increase the dispersion stability of said particles in said binder; and (b) at least one member selected from the group consisting of an electron acceptive material, a coupling agent, and an antioxidant.

* * * * *